US008896427B1

(12) United States Patent
Ramirez

(10) Patent No.: US 8,896,427 B1
(45) Date of Patent: Nov. 25, 2014

(54) PORTABLE THERMAL IMAGE EMERGENCY EXIT MARKING DEVICE FOR FIREFIGHTERS

(76) Inventor: Roland Ramirez, Houston, TX (US)

( * ) Notice: Subject to any disclaimer, the term of this patent is extended or adjusted under 35 U.S.C. 154(b) by 327 days.

(21) Appl. No.: 13/253,955

(22) Filed: Oct. 5, 2011

Related U.S. Application Data

(60) Provisional application No. 61/389,723, filed on Oct. 5, 2010.

(51) Int. Cl.
*G08B 17/00* (2006.01)

(52) U.S. Cl.
USPC ..... 340/286.05; 340/326; 340/332

(58) Field of Classification Search
USPC ..... 340/286.05, 326, 331–333
See application file for complete search history.

(56) References Cited

U.S. PATENT DOCUMENTS

| | | | | |
|---|---|---|---|---|
| 4,524,386 | A | 6/1985 | Scott | |
| 4,584,501 | A * | 4/1986 | Cocks et al. | 313/493 |
| 5,825,280 | A * | 10/1998 | Merendini et al. | 340/326 |
| 6,864,799 | B2 | 3/2005 | Popps et al. | |
| 6,977,627 | B1 * | 12/2005 | Dalton | 345/1.1 |
| 7,196,614 | B2 | 3/2007 | Carolan | |
| 7,528,397 | B2 | 5/2009 | Boyer | |
| 7,626,506 | B2 | 12/2009 | Antonio, II et al. | |
| 7,659,527 | B1 | 2/2010 | Seibert et al. | |
| 8,228,176 | B2 * | 7/2012 | Lewis | 340/332 |
| 2006/0000129 | A1 * | 1/2006 | Chiang | 40/545 |
| 2006/0216011 | A1 * | 9/2006 | Godehn | 396/58 |
| 2012/0023793 | A1 * | 2/2012 | Williams | 40/542 |

* cited by examiner

*Primary Examiner* — Brent Swarthout
(74) *Attorney, Agent, or Firm* — Kenneth A. Roddy

(57) ABSTRACT

A portable thermal image emergency exit marking device for use by firefighters and rescue personnel includes a polygonal housing having electrical heating elements on side panels that are shaped to form infrared heat generating words or symbols indicating an escape exit which are clearly visible by a thermal imaging camera, a flashing strobe light, and an audible alarm, to guide firefighters to the exit of a burning smoke-filled building. The configuration of the infrared heating elements avoids confusion and clearly distinguishes the words or symbols from other hot spots, heat emitting objects, and burning objects in the environment of the burning structure. An accessory adjustably supports the marking device at various heights above the floor surface when desired. The housing may have a ring for connecting a rope that can be extended from the housing to an exit of the burning structure and followed to exit the burning structure.

5 Claims, 2 Drawing Sheets

PORTABLE THERMAL IMAGE EMERGENCY EXIT MARKING DEVICE FOR FIREFIGHTERS

CROSS REFERENCE TO RELATED APPLICATION

This application claims priority of U.S. Provisional Application Ser. No. 61/389,723, filed Oct. 5, 2010.

BACKGROUND OF THE INVENTION

1. Field of the Invention

This invention relates generally to firefighting equipment and infrared signage devices, and more particularly to a portable emergency exit marking device which includes electrical heating elements in the form of letters forming infrared exit wording that is visible by a thermal imaging camera, an audible alarm, and a blinking light for guiding firefighters to the exit of a burning smoke-filled building.

2. Background Art

Firefighters and other emergency personnel operating inside a smoke-filled or burning building or other structure often become disorientated or lost due to the heat and severely limited visibility in the dense smoke and darkness, and many lives are lost each year because they become trapped by the structure are otherwise unable to escape due to operating on a limited air supply because they are unable to find an exit from the burning structure.

Various attempts at overcoming this problem include positioning a fire fighter at an exit of a burning building with a flashlight, or placing a flashlight or lantern at the exit, with the beam of the lamp pointing in the direction from which the firefighter expects to exit later. However, the intensity of light generated by a flashlights and lanterns typically cannot effectively penetrate heavy smoke or flame. There are also currently available, audible and visual alarms, such as strobe lights and LED's, reflectors, colored objects, and similar safety devices that are used to mark an exit. These types of device are also typically not effective due to the limited visibility inside the burning building is limited because of the heavy smoke or flame.

Merendini et al, U.S. Pat. No. 5,825,280 discloses a portable safety light and audible signal apparatus for placement in proximity to a building exit, to guide one or more fire fighters and emergency personnel to the exit during conditions of intense smoke and heat. The portable safety light and audible signal apparatus has a housing for containing, an audible signal generator capable of generating at least three distinctive audible signals, a strobe light mounted upon the top portion of the housing; an inverted U-shaped handle mounted on opposing sides of the strobe light, at least one switch in electrical communication with the strobe light and the audible signal generator, and a portable power supply located within the housing, in electrical communication with the switch.

Popps et al, U.S. Pat. No. 6,864,799 discloses an emergency lighting device for firefighters that marks a viable exit for a building which includes an audible sounder and a number of laser diodes in a housing with lenses that create panes or sheets of light. For example, there may be four laser diodes oriented at various angles. The housing of the device can have prongs that allow the device to pierce drywall so as to mount it near a door or window, as well as an adhesive or cement for mounting the housing on other vertical surfaces. The housing also has a tapered wedge shape and can wedge a door in an open position.

Carolan, U.S. Pat. No. 7,196,614 discloses a guidance device for aiding rescue personnel to quickly locate potential fire victims in a building which includes a body having multiple reflective fields, and a mounting member for securely mounting it to a surface. The body's reflective surfaces may be oriented to reflect approaching light from the top, bottom, left, and right, thereby enhancing its visibility regardless of an approach mode of rescue personnel, and regardless of an orientation in which the guidance device is mounted. The guidance device may include an element such as a metal disc capable of absorbing heat to enhance the guidance device's detection by a thermal imaging camera, or be configured to cause emission of light from responsive to detection of light (e.g. from a firefighter's flashlight). One or more guidance devices may be sold as part of a kit that includes an identification marker mountable adjacent an entry door of a building, and instructions for coordinating mounting positions of the identification marker and the guidance device relative to their respective doors.

Although these prior are exit indicating devices may be effective for their intended purposes, the existing exit indicating devices do not lend themselves to effectively identify the exit in dense smoke and darkness or flame.

More recently, high-tech devices have been developed to improve the safety of fire fighting personnel, such as for example, thermal imaging cameras (TIC's) carried by the firefighters, global positioning units, and head mounted displays in communication with a computer.

Smoke has a large component of micron-sized carbon soot particles in it which absorb visible-light wavelengths. Thermal imaging cameras (TIC's) penetrate heavy smoke and overcome the handicap of darkness to visualize heat sources in situations of limited visibility. Typically, the firefighter relies on thermal patterns visible in the camera display that indicate the presence of a person, a hot spot which may be the source of the fire, or some other thermal characteristic or heat emitting object. Although thermal imaging cameras (TIC's) significantly increase the visibility and display thermal patterns that indicate the presence of a person, hot spots, heat emitting objects, and thermal characteristics of the environment inside the burning structure, they to not identify the exit of the burning structure, nor do they identify conventional exit markers that rely on visible light because the visible wavelengths are outside of the infrared band of the electromagnetic spectrum.

Antonio II, et al, U.S. Pat. No. 7,626,506 discloses a thermal signature device that enables a firefighter to be located with a thermal imaging camera. The device includes an infrared LED which emits light in the infrared wavelength frequency. The infrared LED is situated in a housing that may be temporarily fastened to a firefighter's clothing and manually actuated by the firefighter with a pushbutton to emit infrared signals that may be identified by an infrared camera. The thermal signature device may include a receiver in data communication with the emitting-element such that the emitter may be actuated by a remote transmitter. The housing may include a permanent fastener such as adhesive such that the firefighter may selectively attach the housing to a stationary object, such as a wall, where it may be more visible or to another person in distress. A location determining system utilizing the thermal signature device provides an infrared camera for detecting the emitter-element.

Seibert et al, U.S. Pat. No. 7,659,527 discloses infrared marking device and method for marking an object, such as a door, inside a structure, such as a smoke-filled or burning structure. The infrared marking device comprises a ring-shaped, elasticized outer sleeve having a tubular sidewall and an amount of a self-heating exothermic chemical material confined inside the tubular sidewall of the outer sleeve. The self-heating exothermic chemical material emits infrared radiation when activated. The infrared radiation is visible in a thermal imaging camera. The method comprises activating a self-heating material confined inside a marking device to initiate an exothermic reaction that emits infrared radiation and applying the marking device to an object inside the structure.

These types of devices that utilize infrared LED's and exothermic chemical heaters attached to a firefighter's clothing or to a stationary object, such as a wall, typically only show up in the imaging system as a point or a "hot spot" and are difficult to distinguish from other hot spots, heat emitting objects, and burning objects in the environment of the burning structure.

Various object identifiers have also been developed in the filed of firearms that utilize infrared light for use in producing night vision targets and in targeting and sight calibration for firearms equipped with infrared sighting scopes and thermal imaging cameras.

Scott U.S. Pat. No. 4,524,386 discloses a thermal target display system and method which generates thermal or infrared radiation patterns simulating the thermal "signature" of "real-scene" objects such as vehicles, buildings or personnel which the nightvision or thermal imaging sights were designed to detect, rather than utilizing the real-scene objects themselves as targets. The system utilizes a plurality of individually controlled, active heat-radiating thermal elements disposed in an array to form a thermal screen or target. The thermal elements are disposed upon a substrate of a thermally and electrically insulating material and each element is composed of a layer of film of a conductive resistive coating deposited on substrate between two conducting bus bars across which a differential voltage is impressed to heat the resistive coating. The thermal screen is interfaced with a video system and is energized in response to a video image representing the real-scene object in the infrared spectrum. The gray scale representations of the individual video image pixels are converted into signals which define desired temperature differentials of each of the individual radiating elements of the thermal screen or target, these signals controlling the energization of the thermal elements so that the thermal screen generates a radiation pattern which corresponds to a particular video frame. The thermal radiation pattern, representative of the thermal signature of the real-scene object, can be enhanced and manipulated through conventional video processing techniques.

Boyer, U.S. Pat. No. 7,528,397 discloses a method of creating signage system visible by infrared cameras and infrared weapon sights for calibration of infrared weapon sights. In one embodiment, the signage system comprises a laminar target or sign member formed of a "no power" or "reverse power" material, such as a painted Mylar film, with a front and back surface. The front surface has the characteristic of interfacing properly with any materials adhered to it. The back surface has the characteristic of having low emissivity. A "zeroing target" is printed on the back surface. When viewed through an infrared imaging device, the target will be readily apparent. The laminar member allows any conceivable sign, target, etc. to be created using traditional printing means, such as a silk screening. For additional clarity in the thermal weapons sight, the laminar member can be completely or partially warmed, such that in the area where warmth is applied, the difference in infrared energy emitted from the non-printed front surface relative to the printed surface will increase, and as this difference increases, the clarity in the thermal weapons sight will increase. In a preferred embodiment, the heat is applied to the front surface of the laminar member by a heat generator and a heated surface, which may provide thermal dissipation and/or mechanical stability and may comprise a single object or multiple objects. In a preferred embodiment, a commercially available biodegradable chemical heater is used which begins to warm when exposed to oxygen in the air and requires the target or just the heater to be packaged in an air-tight package to prevent the heater from operating before use. In another embodiment, the heat is applied utilizing an electric heater. Boyer teaches that the heater shape does not have to assume a specific shape because the infrared image is created on the front surface and is a function of the printing, not the geometry of the heater; and that various signs, targets, etc. can be created by altering the shape of the insulator or the cutout portion of the insulator.

Although the prior art devices that utilize infrared light for use in producing night vision targets and in targeting and sight calibration for firearms may be effective for their intended purposes, they would not be suitable for use in a burning structure and would not be effective to indicate or identify an exit of the burning structure.

SUMMARY OF THE INVENTION

The present invention overcomes the aforementioned problems and is distinguished over the prior art in general, and these patents in particular, by a portable emergency exit marking device for use by firefighters and rescue personnel that includes a polygonal housing having electrical heating elements on side panels in the form of letters or symbols that form infrared heat generating words or symbols indicating exit routes that are clearly visible by a thermal imaging camera, a flashing strobe light, and an audible alarm, to guide firefighters to the exit of a burning smoke-filled building. The configuration of the infrared heating elements avoids confusion and clearly distinguishes the words or symbols indicating the escape exit from other hot spots, heat emitting objects, and burning objects in the environment of the burning structure. The housing may also be provided with a ring for releasably receiving one end of a rope that extends from the emergency exit marking device to the exit of the burning structure that can be followed by a firefighter or rescue person to exit the burning structure. A stand accessory may also be provided for adjustably supporting the marking device at various heights above the floor surface when desired.

DESCRIPTION OF THE PREFERRED EMBODIMENT

The present invention is directed toward a portable emergency exit marking device for use by firefighters and rescue personnel that includes electrical heating elements shaped to form infrared heat generating symbols or words indicating exit routes that are visible by a thermal imaging camera, a flashing strobe light, and an audible alarm, to guide firefighters to the exit of a burning smoke-filled building. The making device may also have a ring for releasably receiving one end of a rope that can be extended from the device to an exit of the burning structure and followed to exit the burning structure.

Figure 1:
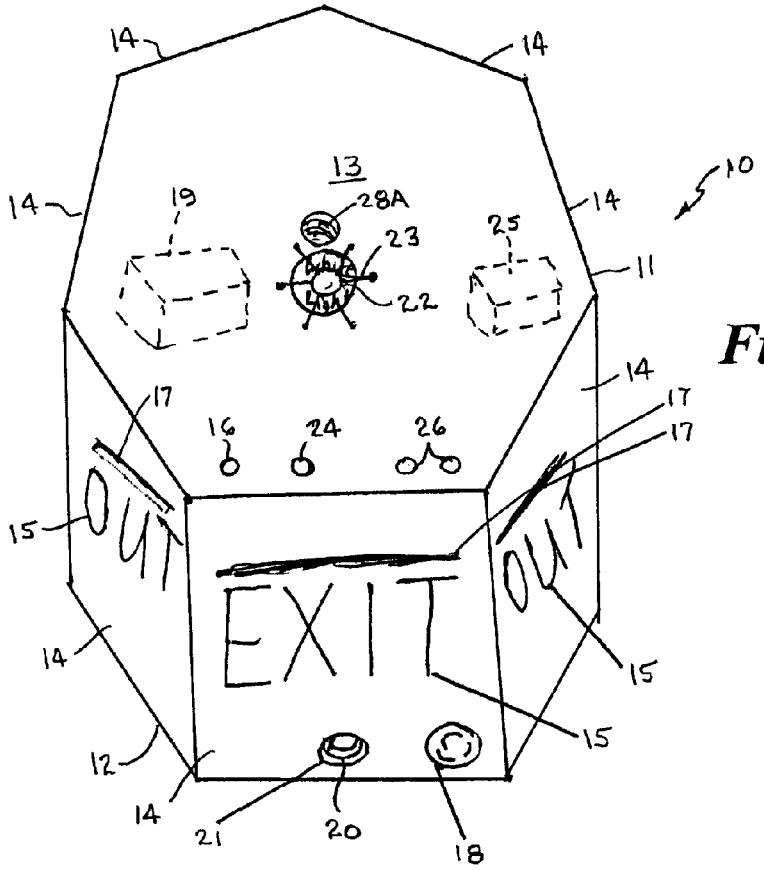
FIG. 1 is a perspective view of the thermal image emergency exit marking device in accordance with the present invention.

Referring now to FIG. 1 of the drawings, the portable emergency exit marking device 10 includes a polygonal housing 11 having a bottom panel 12, a top panel 13 and a plurality of peripheral side panels 14. The polygonal housing 11 is formed of a suitable fireproof heat and shock resistant material, capable of withstanding damage by fire, heat, and other stresses to which it may be exposed in connection with fighting a fire in a burning building. The preferred polygonal housing 11 has seven sides, however it should be understood that there may be any even or odd number of peripheral side panels 14 that will enable at least two side panels to be seen from any angle. The marking device 10 is preferably less than about one foot in height so that it may be placed on the floor of a smoke filled burning structure and more easily seen where the smoke is less dense. An accessory stand 27 (described hereinafter) may also be provided for supporting the marking device 10 at various heights above the floor surface or other surfaces when desired.

An electrical heating element 15 is mounted on each of the side panels 14 of the housing 11. The heating elements 15 are formed of an electrical resistive metal material, similar to the burners of an electric stove, that are configured in the shape of words or symbols that clearly convey information pertaining to a safe exit. For example, but not limited thereto, the heating elements may be shaped as letters to spell out the words "EXIT" and/or "OUT". Alternatively, the heating elements may be shaped to spell out other words or symbols that indicate a safe exit route.

The heating elements 15 are coupled with a source of electrical current through a control switch 16 mounted on the housing 11 to heat the elements sufficiently to emit thermal energy in the infrared wavelength band so as to be clearly visible by a thermal imaging camera (TIC). Thermal imaging cameras detect radiation in the infrared range of the electromagnetic spectrum (roughly 900-14,000 nanometers or 0.9-14 micrometers) and produce images of that radiation. The control switch 16 is preferably adjustable so as to adjust the heating elements 15 to produce thermal energy higher than the heat of the fire or environment in which the device is located. The detection threshold of the electronics in the thermal imaging camera may also be adjusted so that low temperature objects are not visible in the displayed image and to improve the image contrast between the heating elements 15 and background objects so that the heating elements are discernable and clearly distinguished.

The heating elements 15 are preferably recessed or otherwise protected by a surrounding cover, a wire cage, or a raised rim around their periphery to prevent them from being accidentally contacted. A water run-off gutter 17 may be mounted on the housing 11 above the heating elements 15 to protect them from water running down the face of the panels 14.

The heating elements 15 are coupled to a remote electrical power source by an electrical receptacle 18 mounted on a panel 14 of the housing 11 which removably receives a mating plug at the end of a waterproof insulated electrical cord connected to the remote power source. The electrical receptacle 18 preferably is a twist-lock type to prevent accidental disconnection and has a flip-top cover. A rechargeable battery 19 is contained within the housing 11 and connected with the heating elements 15 to provide power to the heating elements when a remote power source is not available.

A ring 20 may be mounted on a panel 14 of the housing 11 for clipping one end of a rope thereto. Preferably the ring 20 is mounted in a recess 21 to prevent it from protruding outwardly and accidentally snagging on clothing or other objects. One end of a fireproof rope extended from the exit of the burning structure may be releasably connected to ring 20 and the rope can be followed from the emergency exit marking device 10 to the exit of the burning structure to safely exit the smoke-filled dark environment of the burning structure.

In addition to the infrared heating elements, a blinking or flashing high intensity strobe light 22, preferably a white strobe light, mounted within a clear protective waterproof cover is mounted on the top panel 13 of the housing 11 to provide a visual signal to aid in the visual location of the emergency exit marking device 10. The light 22 and clear cover may be covered with a wire frame protective cover 23 to prevent breakage. The light 22 is connected with the electrical source through a control switch 24 mounted on the housing 11. The control switch 24 is preferably adjustable to selectively control the number of flashes per minute of the strobe light 22.

An audible signal generating means 25 may also be disposed within the housing 11 and connected with the electrical source through one or more control switches 25 mounted on the housing to provide an audible signal to aid in the location of the emergency exit marking device 10. The audible signal generating means 25 is preferably capable of generating a distinctive loud chirping sound and the control switches 25 preferably include switches for adjusting the decibel level and the chirping cycle of the audible signal.

Figure 2:
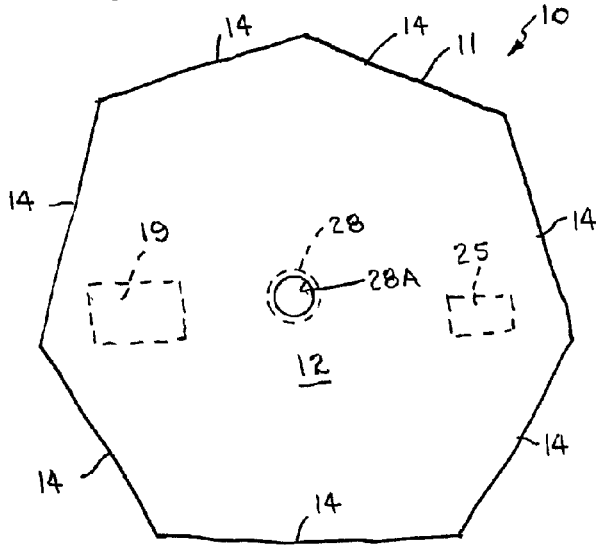
FIG. 2 is a bottom plan view of the emergency exit marking device.
Figure 3:
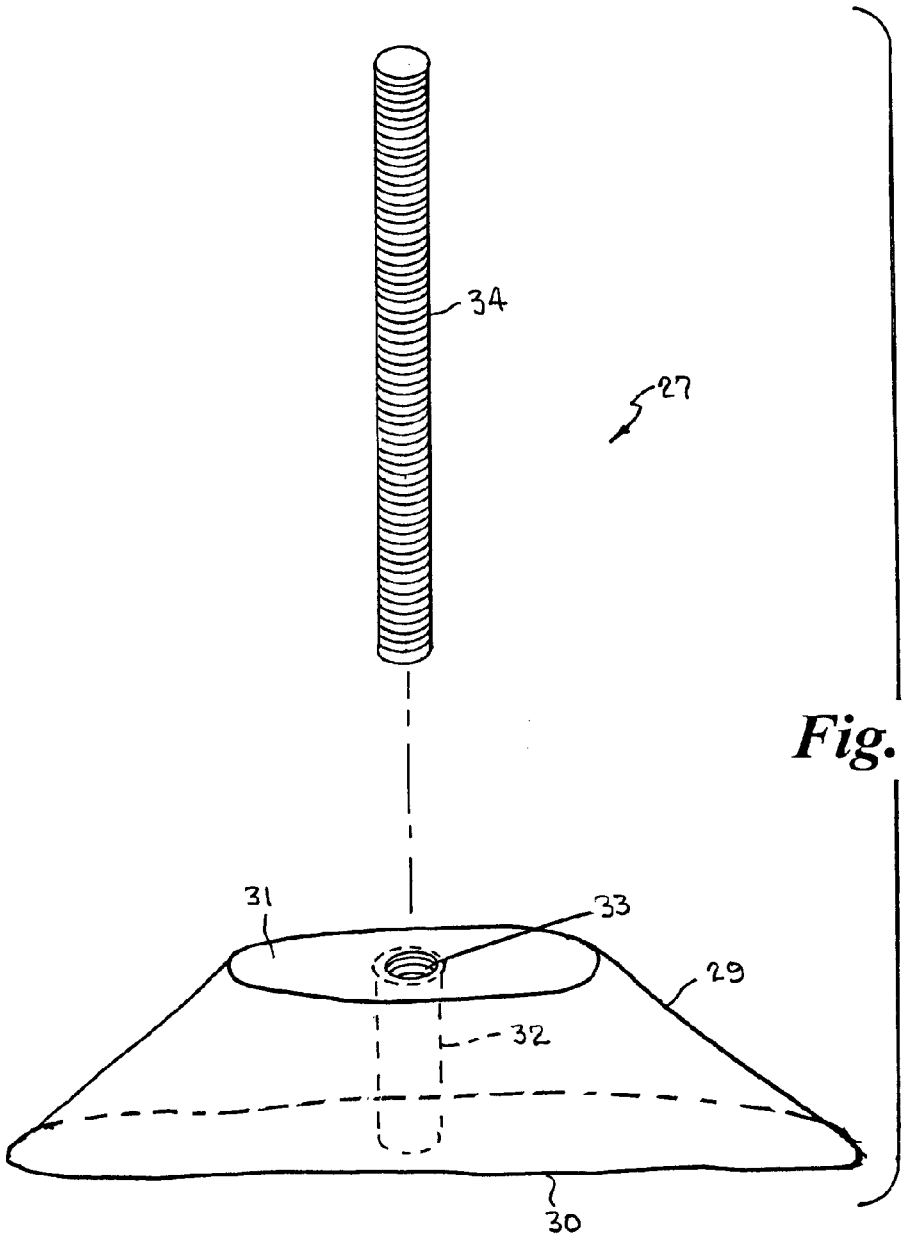
FIG. 3 is a perspective view of a support stand and threaded adjustment rod for supporting the emergency exit marking device and various heights.

Referring additionally to FIGS. 2 and 3, an accessory stand 27 may also be provided for supporting the marking device 10 at various heights above the floor surface when desired. The housing 11 is provided with a tubular member 28 having internal threads 29 that extends vertically inside the housing 11 from the bottom panel 12, to the top panel 13. The stand 27 includes a base member 29 and an elongate externally threaded rod 34. The base member 29 has a bottom wall 30, a top wall 31, and a tubular member 32 having internal threads 33 that extends vertically inside the base from the bottom wall, to the top wall. In the illustrated example, the base 29 has a truncated conical configuration with a larger diameter bottom wall 30 and a smaller diameter top wall 31; however, it should be understood that the base may be configured otherwise.

To connect the accessory stand 27, one end of the elongate externally threaded rod 34 is threadedly engaged in the internally threaded tubular member 32 of the base 29, and the housing 11 is placed bottom side down on the opposed end of the rod 34 and rotated to threadedly engage the internally threaded tubular member 28 of the housing 11 on the upper end of the elongate rod. Thereafter, the housing 11 may be rotated to adjustably support the housing 11 of the emergency escape device 10 at various heights.

It should be understood from the foregoing description that the marking device 10 may be placed on the floor of a smoke filled burning structure supported on its bottom panel 12 where the smoke is less dense, or may be optionally supported by the accessory stand 27 at various heights above the floor surface or other surfaces when desired.

Smoke has a large component of micron-sized carbon soot particles in it which absorb visible-light wavelengths. The thermal imaging camera penetrates heavy smoke and converts infrared radiation emitted by the heating elements 15 to clearly visible images indicating the escape exit. For example, but not limited thereto, the heating elements may be shaped to spell out the words "EXIT" and/or "OUT" clearly visible in the camera's display. This significantly avoids confusion and clearly distinguishes the visible images indicating the escape exit from other hot spots, heat emitting objects, and burning objects in the environment of the burning structure. As discussed above, the thermal energy of the heating elements 15 may be increased to be above the temperature of the fire in the burning structure, and thus, increase the brightness of the symbols or words displayed in a color or gray scale. The detection threshold of the electronics in the thermal imaging camera may also be adjusted so that low temperature objects are not visible in the displayed image and to improve the image contrast between the heating element and other heat sources and background objects.

It should be understood that electric heating elements 15 shaped to spell out the words "EXIT" and/or "OUT" are presented for purposes of example only, and that they may be configured in the shape of various other words or symbols that clearly distinguish the actual exit from other hot spots, heat emitting objects, and burning objects in the environment of the burning structure.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A portable thermal image emergency exit marking device for use by firefighters and rescue personnel to mark an escape exit from a burning structure, comprising:

a portable polygonal housing constructed of fireproof, heat and shock resistant material, having a top panel, a bottom panel, and side panels adapted to be placed in the burning structure;

an electrical receptacle mounted on one of said panels for removably receiving a mating plug at the end of a waterproof insulated electrical cord connected to a remote electrical power source;

electrical heating elements on said side panels connectable to said electrical power source, said heating elements formed of an electrical resistive metal material shaped to form heat generating words or symbols indicating an escape exit from the burning structure; and an adjustable electrical control switch mounted on said housing operatively connected between said electrical heating elements and said electrical power source to heat said electrical heating elements sufficient to emit thermal energy in the infrared wavelength band higher than the heat of the fire or environment of the burning structure in which said housing is placed so as to be clearly visible by a thermal imaging camera; such that said words or symbols formed by said heated electrical heating elements are discernable and clearly visible by the thermal imaging camera and are clearly distinguished from other hot spots, heat emitting objects, and burning objects in the environment of the burning structure to indicate the escape exit from the burning structure.

2. The portable thermal image emergency exit marking device according to claim 1, further comprising:

a flashing strobe light having a protective cover mounted on said housing top panel connectable to said electrical power source by an adjustable control switch on said housing, said control switch adjustable to selectively control the number of flashes per minute of said strobe light.

3. The portable thermal image emergency exit marking device according to claim 1, further comprising:

an audible alarm disposed in said housing connectable to said electrical power source by adjustable control switches on said housing to generate a distinctive loud chirping sound, and said control switches include switches for adjusting the decibel level and the chirping cycle of said audible alarm to provide an audible signal to aid in determining the location of said emergency exit marking device.

4. The portable thermal image emergency exit marking device according to claim 1, further comprising:

a stand releasably and threadedly connectable with said housing to extend from said bottom panel and having a support base at a bottom end, said housing and said stand being rotated relative to one another to adjustably support said housing at selected heights above a floor surface.

5. The portable thermal image emergency exit marking device according to claim 1, further comprising:

a ring on said housing for releasably receiving one end of a fireproof rope that can be extended from said housing to an exit of the burning structure and followed by a firefighter or rescue person to exit the burning structure.

* * * * *